US005788090A

United States Patent [19]

Kajiwara

[11] Patent Number: 5,788,090

[45] Date of Patent: Aug. 4, 1998

[54] COMMODITY DISPLAY UNIT

[75] Inventor: Kiyoharu Kajiwara, Kawaguchi, Japan

[73] Assignee: Amix Co., Ltd., Kawaguchi, Japan

[21] Appl. No.: 637,046

[22] Filed: Apr. 24, 1996

[30] Foreign Application Priority Data

Apr. 28, 1995 [JP] Japan ..... 7-106742

[51] Int. Cl.[6] ..... A47F 7/00

[52] U.S. Cl. ..... 211/59.2; 211/151

[58] Field of Search ..... 211/59.2, 151, 211/187; 312/71

[56] References Cited

U.S. PATENT DOCUMENTS 3,900,112 8/1975 Azzi et al. ..... 211/59.2 X
5,115,920 5/1992 Tipton et al. ..... 211/59.2
5,259,518 11/1993 Sorenson et al. ..... 211/59.2
5,295,591 3/1994 Slater ..... 211/59.2

*Primary Examiner*—Alvin C. Chin-Shue
*Assistant Examiner*—Sarah L. Purol
*Attorney, Agent, or Firm*—Wenderoth, Lind & Ponack, L.L.P.

[57] ABSTRACT

A commodity display unit has a commodity advancing device which is disposed aslant frontward along a bottom of a commodity container so as to move a column of the frontward commodities forward in the container. When the forwardmost commodity is removed from a commodity takeout position, defined at a front portion of the commodity container, the remaining commodities spontaneously move forward. The commodity advancing device is formed of a procession of rollers arranged in parallel along the display lane and inclined downwardly so as to effect forward movement of the commodities, thus permitting the commodities of be easily removed one at a time.

13 Claims, 15 Drawing Sheets

COMMODITY DISPLAY UNIT

[BACKGROUND OF THE INVENTION]

1. Field of the Invention

This invention relates to a commodity display unit for easily taking commodities such as canned goods out of commodity display shelves, and more particularly to a commodity display unit capable of being removably placed on a commodity display shelf and permitting commodities contained in a column to be easily taken out of the front portion of the display unit at the time and replenish commodities with ease.

2. Description of the Prior Art

In the majority of cases, various commodities such as canned, bottled and paper-packed goods are arranged in columns for each kind of commodities to be displayed on display shelves in a shop. Since most customers are likely to take out a desired one placed in the front of the commodities arranged on the shelf, some commodities are apt to be left deep in the shelf.

The commodities left deep in the display shelf are inconvenient to be taken out, and what is more, disfigure the exhibition of commodities, thus forcing troublesome rearranging labor upon a shop clerk, so as to move frontward the commodities left deep in the shelf.

To avoid such inconvenience as stated above, the inventor of this invention has previously proposed a commodity display shelf unit comprising a plurality of commodity containers each having a sloping guide bottom (Japanese Utility Model Application Public Disclosure No. HEI 2-68753(A)). The commodity container of the proposed commodity display shelf unit is freely removable from commodity display shelves and has a plurality of ribs extending longitudinally on the aforesaid guide bottom on which the commodities are placed in a line. The aforesaid ribs serve to reduce the contact area of the commodity and the guide bottom to decrease surface frictional resistance occurring therebetween, thus permitting the commodity in the shelf unit to spontaneously slide down the sloping guide bottom frontward.

Although the commodity container of the conventional prior art can decrease the surface frictional resistance occurring between the commodity and the guide bottom owing to the ribs formed on the guide bottom, it cannot always warrant smooth sliding of the commodity on the guide bottom against the contact friction caused relative to the guide bottom. Under certain circumstances, this commodity container possibly entails a disadvantage such that the commodity is prevented from sliding on the guide bottom.

There has been proposed a showcase in Japanese Utility Model Application Public Disclosure No. SHO 64-41367 (A), which has a sloping bottom with a multitude of rollers arranged in parallel so as to permit a commodity placed thereon to slide down frontward. The aforesaid showcase integrated with the bottom having lots of rollers entails a disadvantage such that it is complicated in structure, resulting in a large overall size and renders the repair and maintenance of the rollers difficult. There has been pointed out a further disadvantage such that the unstable commodities displayed in the showcase are apt to topple over sideways.

Another showcase having a drawable shelf, on which commodity guide grooves curved in the shape of U is disclosed in Japanese Utility Model Application Public Disclosure No. SHO 62-16360. This showcase is however ineffective when there are not contained many commodities.

[OBJECT OF THE INVENTION]

The present invention was made to overcome the shortcoming of the conventional showcases or display shelves and has an object to provide a commodity display unit capable of being removably placed on an existing commodity display shelf and containing a large number of commodities so that the commodities can be displayed effectively and easily removed.

Another object of this invention is to provide a commodity display unit having commodity advancing means for permitting commodities to spontaneously move frontward surely and smoothly so that the commodities contained in a column can be removed one by one from the front portion of the unit at the time and stably held without toppling sideways.

Still another object of this invention is to provide a commodity display unit which is convenient for taking in and out commodities and can be easily maintained.

The other object of this invention is to provide a commodity display unit having a mechanism capable of mounting and dismounting commodity advancing means for permitting commodities contained therein to move frontward spontaneously.

[SUMMARY OF THE INVENTION]

To attain the object described above according to this invention, there is provided a commodity display unit comprising a commodity container for containing a column of commodities, commodity advancing means disposed aslant on the bottom of the commodity container to permit the commodities contained therein to move frontward, and a commodity stopper disposed on the front end of the container.

The commodity container has one commodity advancing means for each column of commodities, and side panels opposed to each other astride the commodity advancing means. Thus, the commodities can be stably held in a column and steadily moved to the takeout portion at the forefront of the container.

The commodity advancing means has a plurality of rollers arranged in parallel. The rollers may be stationarily or detachably mounted between the opposite side panels of the commodity container, or held by a support means removable from the commodity container.

The commodity container may be made narrow in width so as to arrange the commodities in a column, or wide so as to contain columns of commodities. The commodity container capable of containing the columns of commodities may be formed with the side panels formed one on either side of the container and partition side panels located between the respective columns of commodities, and a procession of rollers disposed between the side panels.

The commodity advancing means having the sloping bottom exerts a frontward sliding force to the commodities arranged in a column in the commodity container to move the commodities frontward, thus bringing the commodity placed at the forefront of the container into contact with the commodity stopper disposed at the front end of the commodity container at all times. When taking the forefront commodity out of the commodity container, the following commodities spontaneously move smoothly to the takeout portion at the forefront of the container. Similarly, the commodities spontaneously move toward the takeout portion at the forefront of the container by means of the smoothly rotatable rollers constituting the commodity advancing means no matter what the shape and size of the commodity is.

The aforementioned and other objects and features of the present invention will be hereinafter described in detail with reference to the accompanying drawings.

[DESCRIPTION OF THE PREFERRED EMBODIMENTS]

The commodity display unit according to this invention makes it possible to display various commodities such as canned goods so as to easily remove the commodities from a display shelf in a shop. The first embodiment of the invention will be explained hereinafter with reference to FIG. 1 through FIG. 5.

Figure 5:
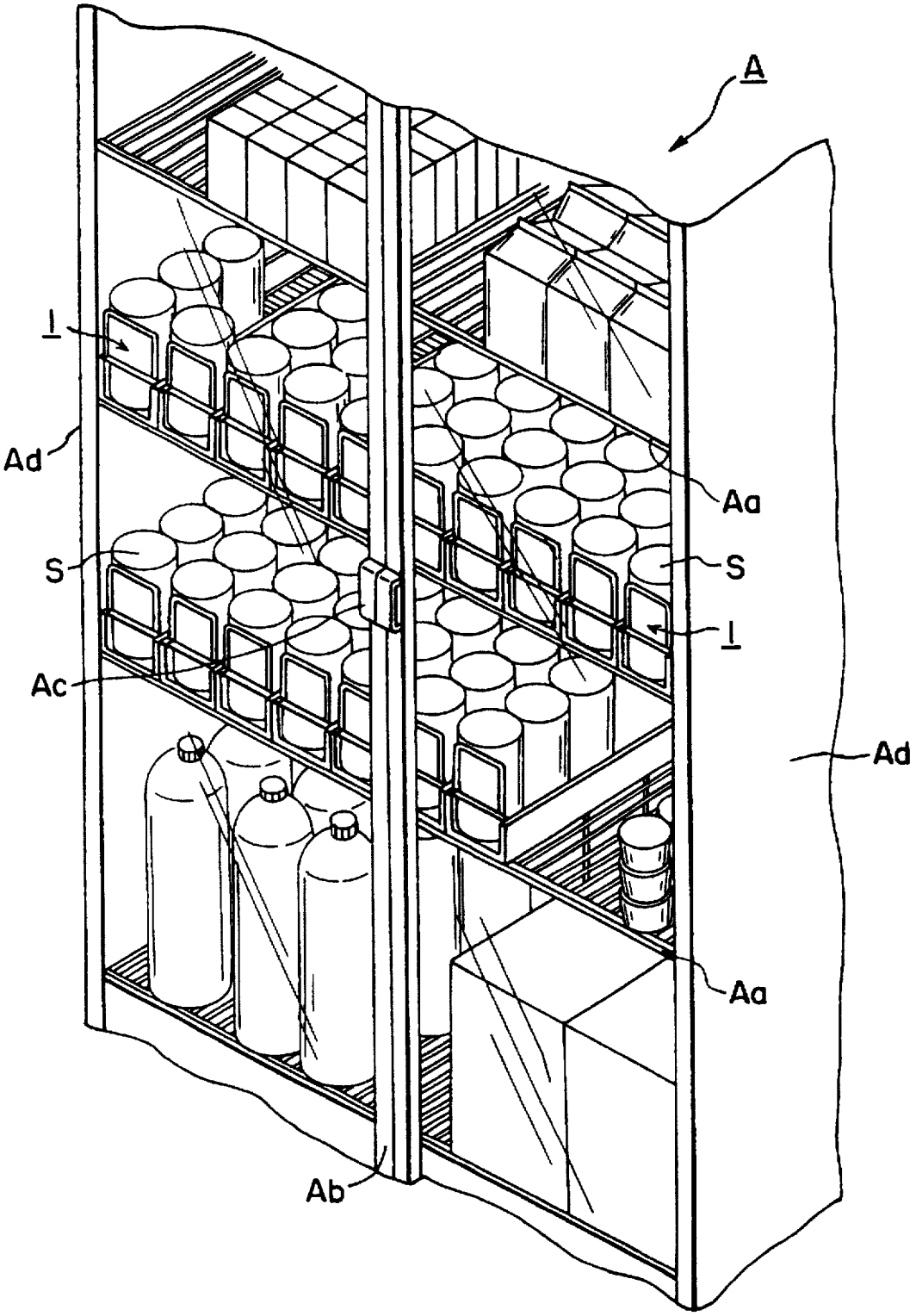
FIG. 5 is a perspective view showing the first embodiment of the commodity display unit of the invention in the state assumed during its use.

As illustrated in FIG. 5 by way of example, the commodity display unit of the invention in use may be placed removably on a shelf Aa in a commodity display larder or case A such as a large refrigerator used for business purposes. Although cylindrical canned goods handled in this embodiment are assumed as the commodity S, the size and shape of the commodity are by no means limitative, and various kinds of goods having not only regular sizes such as bottled goods and paper-packed goods, but also an indefinite number of shapes can be contained fittingly, to say nothing of goods other than foods.

In general, the commodity S stored in the commodity display larder A is taken out by opening the front door Ab. The shelf Aa is held removably by side walls Ad so that the height at which the shelf is positioned can be adjusted. However, the structure to which this invention is applied, i.e. the commodity display larder A in this embodiment, should not be understood as being limited thereto. That is, this invention is applicable to a common showcase and display rack.

The commodity display unit in this embodiment comprises a commodity container 1, a commodity advancing means including rollers 2, lower roller supports 3, and upper roller supports 4, and a stopper 5.

The commodity container 1 in this embodiment is formed like a box having an upper opening, and has a pair of side panels 11, a rear panel 12 connecting the rear ends of the side panels 11, a front panel 13 connecting the front ends of the side panels, and a bottom panel 14 connecting the lower ends of the side panels. The side panels 11, rear panel 12, front panel 13 and bottom panel 14 define a commodity display lane 10.

The front panel 13 may be made of a transparent or semitransparent synthetic resin plate so a consumer is able to discern the commodities contained in the unit by looking through the front panel.

The entirety of the commodity container 1 except for the transparent or semitransparent front panel may be preferably made of stainless steel having good heat conductivity and good corrosion resistance, but it may be made of any other material, e.g. synthetic resin material.

The interval between the side panels 11, i.e. the width La of the commodity container 1, may be made slightly larger than the diameter or width of a commodity S to be displayed. The length Lb of the side panel 11 of the commodity container 1 may be determined in accordance with the required number of commodities S to be ranged in a column.

In the inner surfaces 111 of the side panels 11 close to the bottom panel 14, screw holes 112 for receiving screws 6 to retain the lower roller supporter 3 and the upper roller supporter 4 are formed at regular intervals in the longitudinal direction. The aforesaid screw holes 112 are formed on the line sloping toward the front portion of the container so that the lower roller support 3 and upper roller support 4 are inclined downward from the rear portion toward the front portion of the container.

The plurality of rollers 2 partially constituting the commodity advancing means for accelerating the self-movement of the commodity are arranged in parallel with one another in a procession along the lane 10 in the container 1. It is desirable to make the roller 2 of materials having good smoothness and sufficient low-temperature brittleness, such as ABS resin containing silicon or polycarbonate resin containing fluorine, but the material of the roller is not so limited in the invention. The roller 2 consists of a cylindrical trunk 21 and shafts 22 extending one from either side of the trunk 21.

Figure 1:
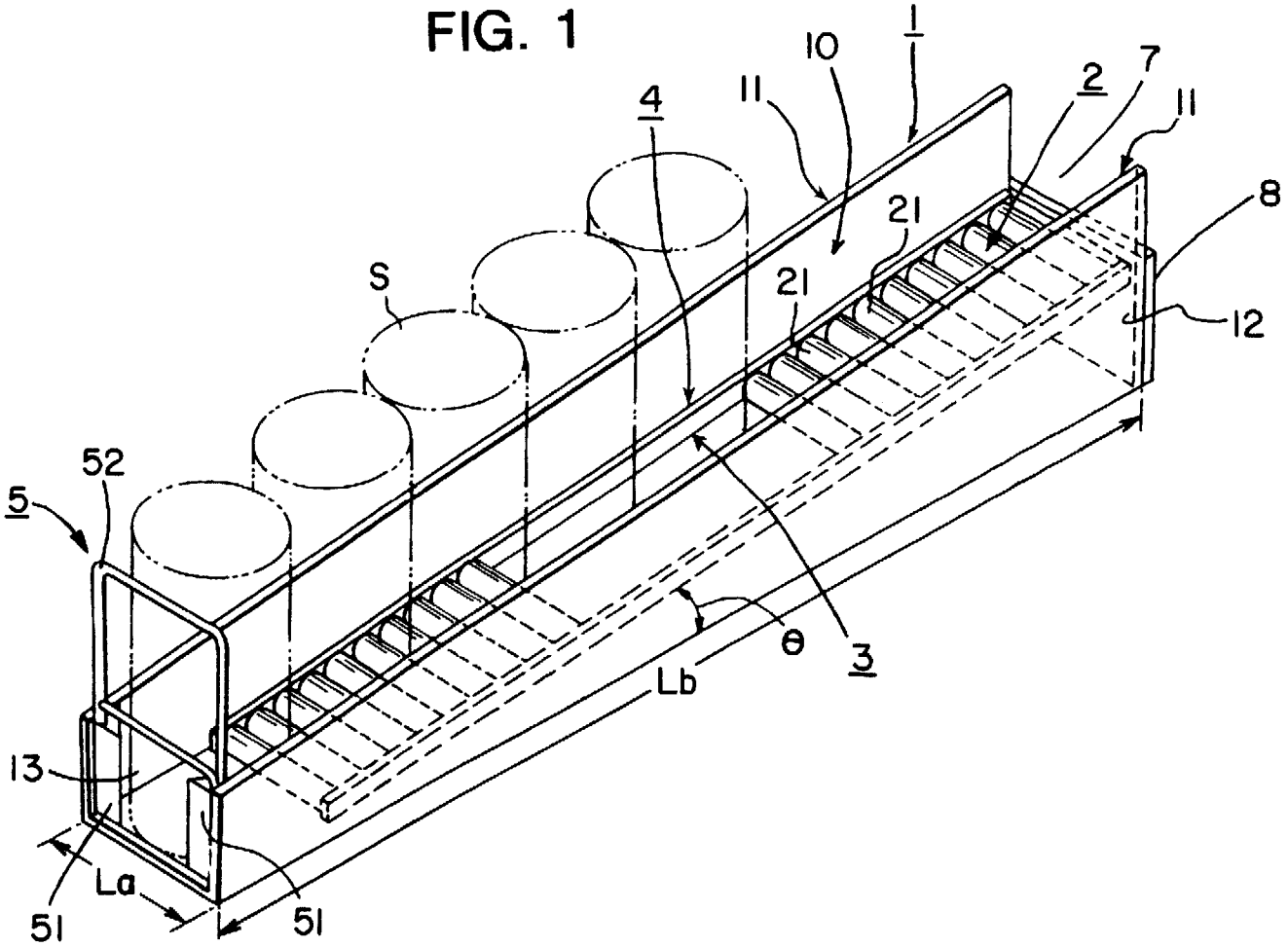
FIG. 1 is a perspective view illustrating a first embodiment of the commodity display unit according to this invention.
Figure 2:
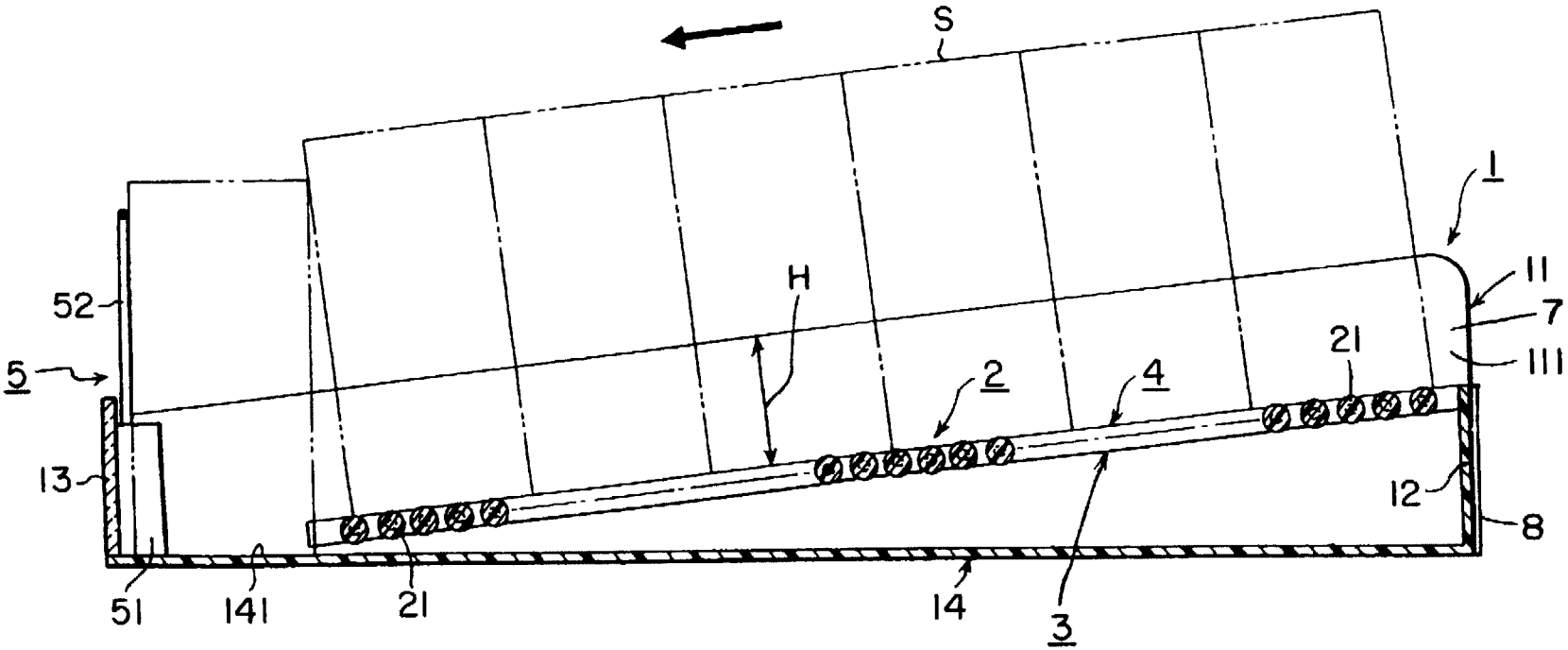
FIG. 2 is a longitudinal sectional view of FIG. 1.
Figure 3:
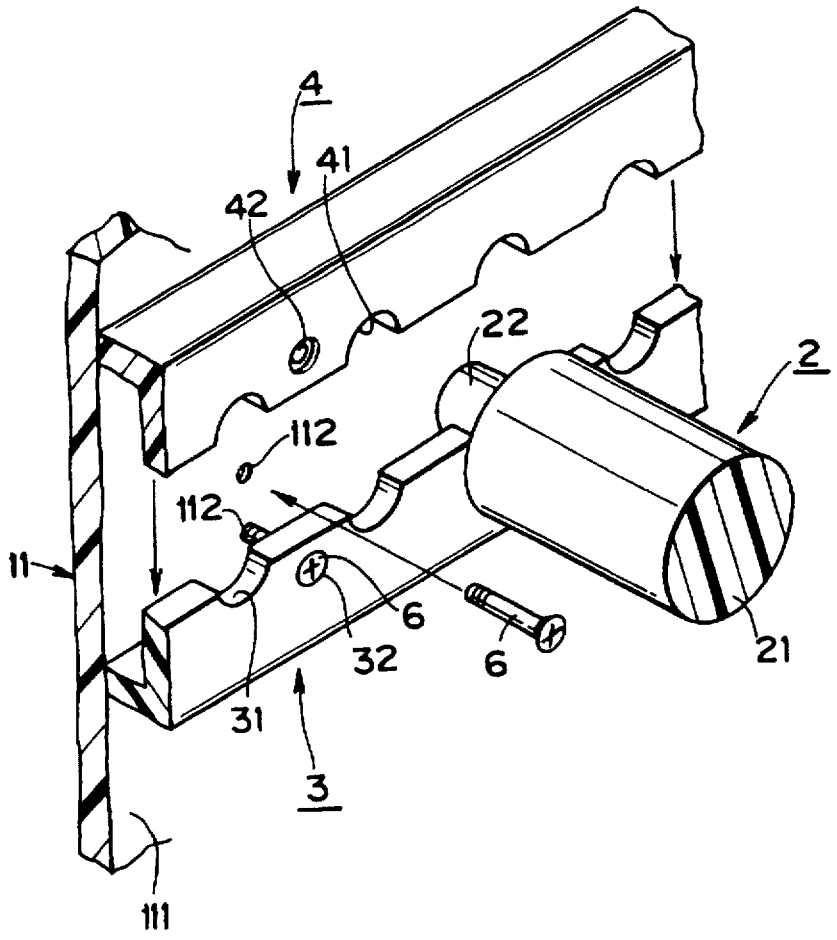
FIG. 3 is an enlarged perspective view showing a roller supporting structure of this invention in an exploded state.
Figure 4:
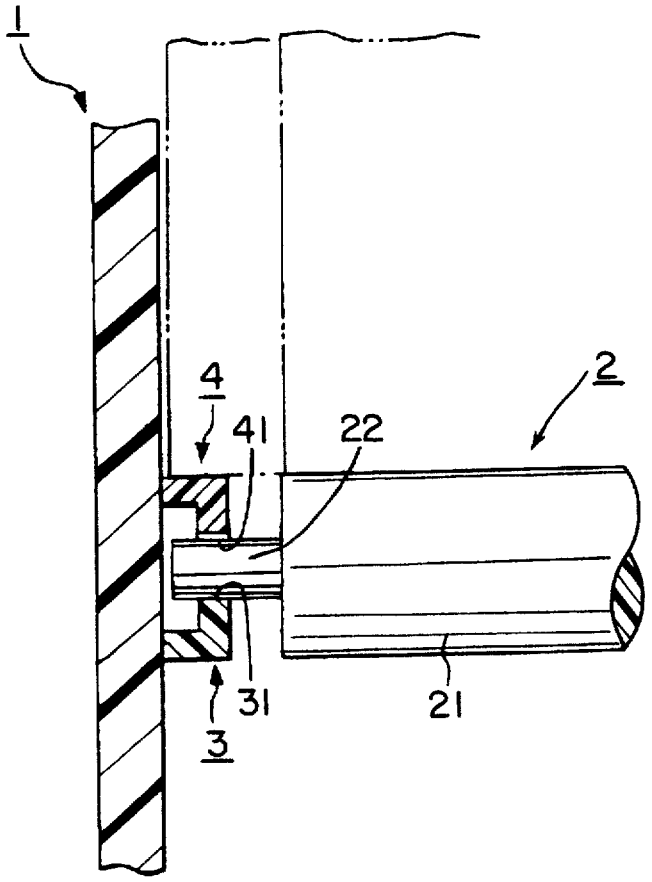
FIG. 4 is a transverse sectional view of the roller supporting structure of the invention.

The lower roller support 3 in this embodiment is formed of a slender member having a substantially L-sectioned shape and provided in its upper edge with semicircular bearing grooves 31 as illustrated in FIG. 3. The lower roller support 3 is shorter than the side panel 11 of the commodity container 1 by the diameter or longitudinal length of one commodity S (see FIG. 2).

The lower roller support 3 further has screw-insertion holes 32 bored at the positions opposite to the screw holes 112 in the side panel 11 of the commodity container 1.

On the other hand, the upper roller support 4 is formed of a slender member having a substantially L-sectioned shape and provided in its upper edge with semicircular bearing grooves 41, and has a length nearly equal to the lower roller support 3 and screw-insertion holes 42 bored at the positions opposite to the screw holes 112 formed in the side panel 11 of the commodity container 1.

The rollers 2, lower roller supports 3 and upper roller supports 4 which constitute the commodity advancing means are detachably mounted onto the both side panels 11 of the commodity container 1. That is, as shown in FIG. 3, the commodity advancing means is assembled by securing the lower roller supports 3 to the side panels 11 of the commodity container 1 with the screws 6, setting the shafts 22 of the rollers 2 in the bearing grooves 31 of the lower roller supports 3, and securing the upper roller supports 4 to the side panels with the screws 6 while fitting the shafts 22 of the rollers 2 into the bearing grooves 41 of the upper roller supports 4. The lower roller supports 3 and upper roller supports 4 thus secured have round bearing holes defined by the bearing grooves 31 and 41, so that the rollers 2 can be held rotatably by the side panels 11 in the commodity container 1. As a result, the procession of rollers slopes frontward in the longitudinal direction.

The inclination angle θ of the procession of rollers 2 is within 3 to 10 deg., preferably, 4 to 5 deg.

The height H from the upper surface of the side panel 11 in the commodity container 1 to the procession of rollers (rollers 2) may be determined within the range of one-fourth to one-third of the height of the commodity S, as shown in FIG. 2. The upper surface of the upper roller support 4 may be made on a level with the peak of the trunk 21 of the roller 2, or the peak of the roller 21 may be made somewhat higher than the upper surface of the upper roller supporter 4.

The stopper 5 has an L-shaped support portion 51 secured between the front end portions of the side panels 11 of the commodity container 1 and the front panel 13, and a main portion 52 extending upward from the support portion 51 and formed by bending a rod into the shape of a substantially inverted U so as to have a height slightly lower than the height of the commodity S. With the main portion 52 of the stopper 5, the commodity S placed in the takeout position 141 defined at the front portion of the bottom panel 14 of the commodity container 1 can be prevented from falling down.

A commodity supply port 7 is formed by opening the rear panel 12 of the commodity container 1 over the rear roller 2 so that the commodities can be supplied into the container from the rear side. Onto the back face of the rear panel 12, an indicator panel 8 for exhibiting information as to the commodities S contained, such as a trade name, maker's name, and price, may be attached.

According to this embodiment, the commodity container 1 with the commodities to be displayed can be readily placed on the shelf Aa in the commodity display larder A, so that the commodities can be conveniently taken in and out and ascertained visually.

In a case in which the commodity display larder A has not only a front transparent door but also a rear transparent door, additional commodities S can be supplied into the container through the commodity supply port 7 formed in the rear side of the container 1 on referring to the indication on the indicator panel 8 attached to the back face of the container, without pulling the container out of the commodity display larder A. The commodities S supplied into the container through the commodity supply port 7 slide down the rollers 2 frontward and come to a standstill at the front portion of the container in such a state that the forefront commodity comes in touch with the stopper 5.

The forefront commodity S placed at the takeout position 141 of the front portion of the commodity display container 1 is in an upright orientation, but the following commodities placed on the rollers 2 are tilted frontward by the angle at which the procession of rollers 2 is inclined. Therefore, the forefront and following commodities are in substantial point contact with each other because both are shaped as a cylinder, thus permitting the forefront commodity to be taken out with little resistance. Furthermore, since the front panel 13 of the commodity container 1 is made transparent or semitransparent, the commodity contained in the container can be visually ascertained by looking through the stopper 5 formed in a substantially inverted U-shape. Accordingly, it is unlikely to misidentify the commodity S to be taken out.

When the forefront commodity S is taken out, the following commodities S spontaneously move forwardly one after another over on the rotating rollers 2. At this time, the advance of the commodities S is not restrained by the upper roller supports 4 because the upper surfaces of the upper roller supports 4 are on a level with or lower than the peaks of the trunk 21 of the rollers 2. Consequently, the commodities smoothly advance surely.

According to this embodiment, since the rollers 2, lower roller supports 3 and upper roller supports 4 can be readily assembled and disassembled, the rollers 2 are selectively exchangeable for other rollers of adequate material and diameter capable of warranting satisfactory rotation in accordance with the weight or other conditions of the commodity S.

The commodity takeout position 141 defined by the front part of the bottom panel 14 may be left out so as to place the front commodity S directly on the shelf Aa of the commodity display larder A.

The aforesaid commodity container 1 may be secured directly onto the side walls of the commodity display larder A by use of holder hooks for holding the shelf Aa on the commodity display larder A.

The upper roller support 4 may be retained detachably from the lower roller support 5.

Figure 6:
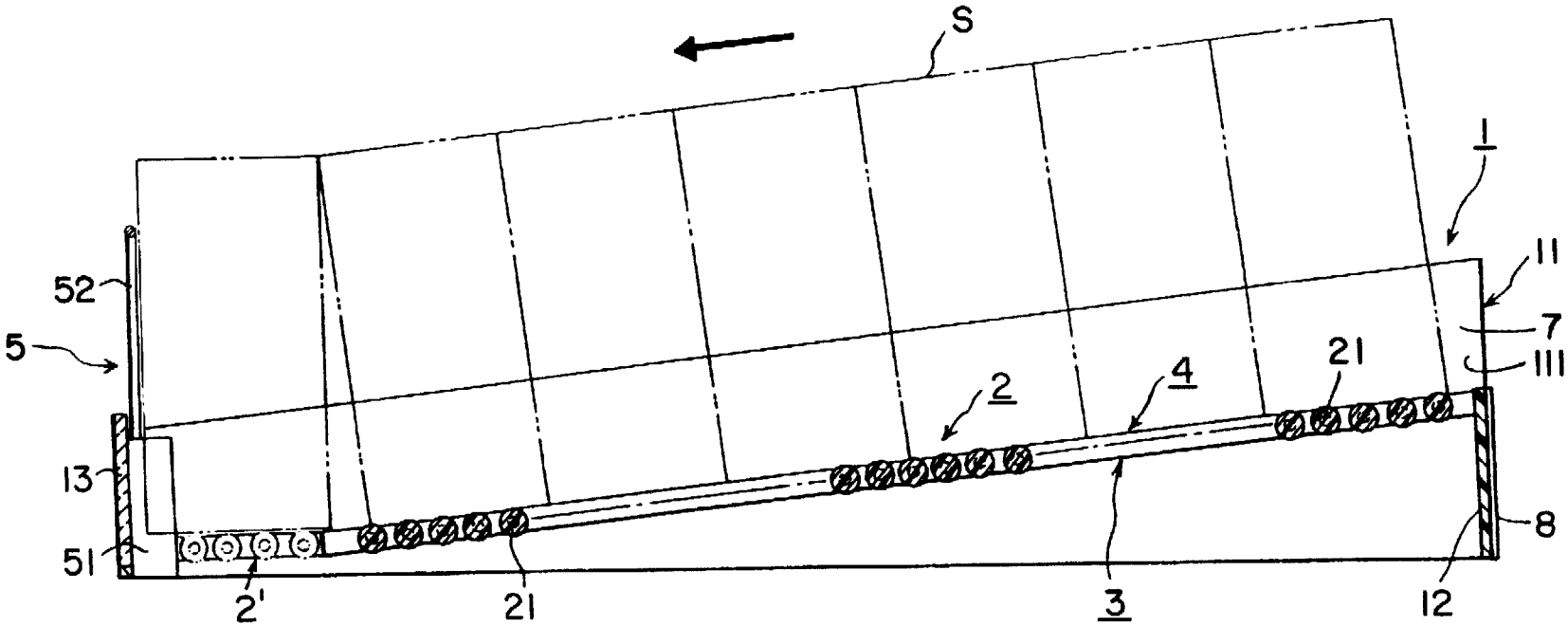
FIG. 6 is a perspective view illustrating a second embodiment of the commodity display unit according to this invention.
Figure 7:
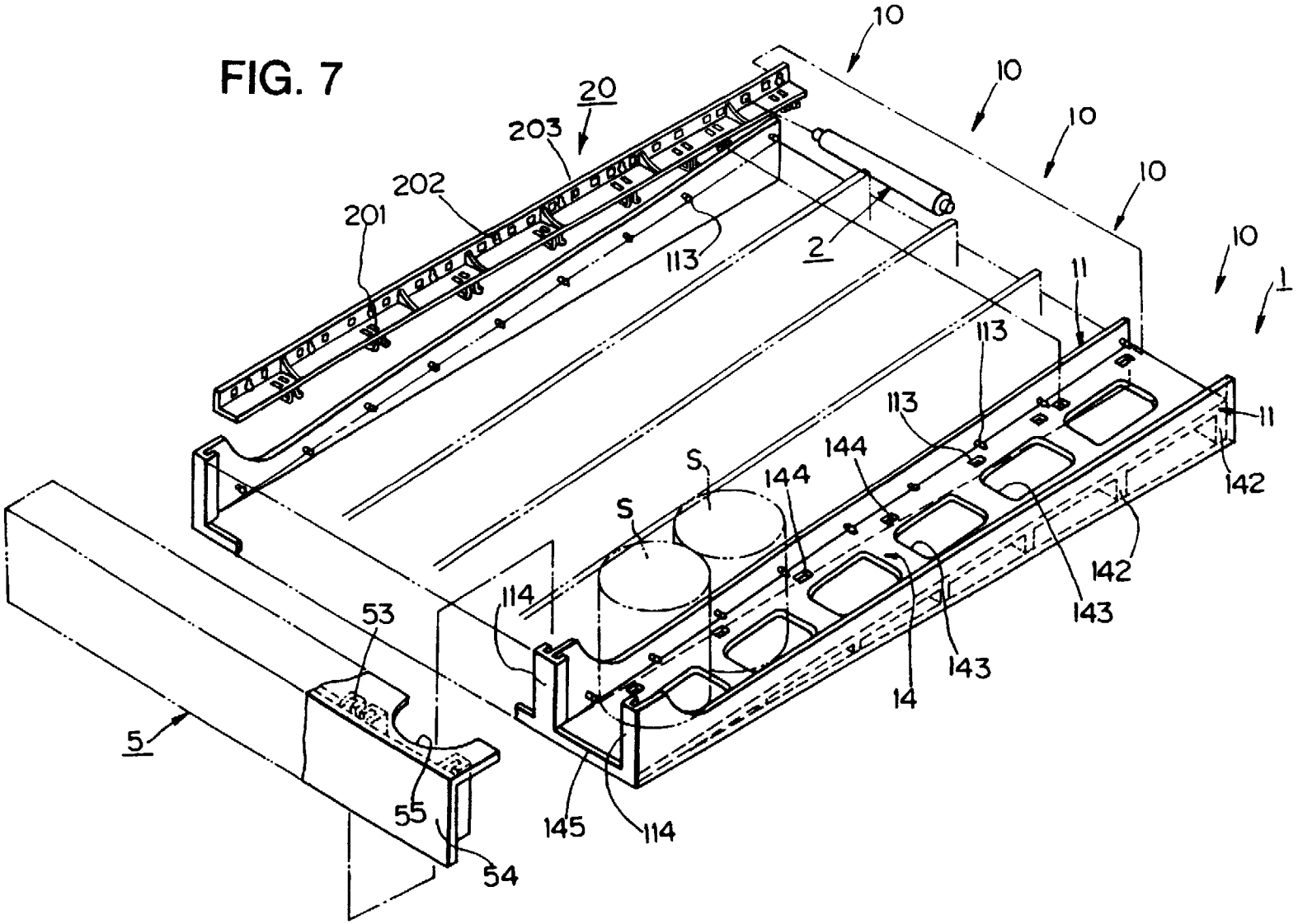
FIG. 7 is a partially exploded perspective view showing a third embodiment of the commodity display unit according to this invention.
Figure 8:
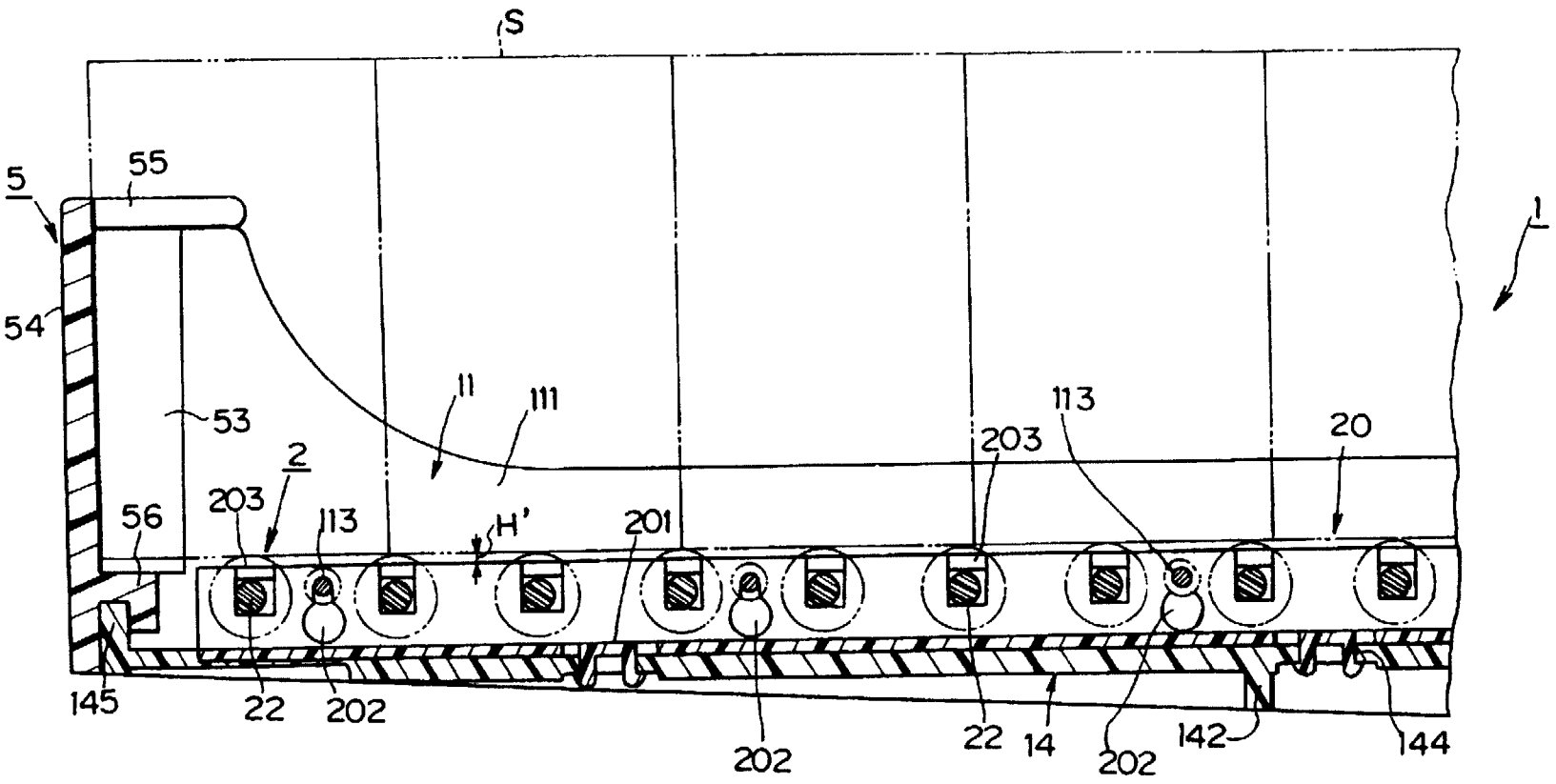
FIG. 8 is a longitudinal sectional view showing the principal portion of the unit of FIG. 7.

The second embodiment of the commodity display unit according to the present invention as shown in FIG. 6 is constructed by taking off the bottom panel 14 in the commodity container 1 of the aforenoted first embodiment, and instead, disposing additional rollers 2 arranged horizontally at the commodity takeout position 141.

According to this embodiment, since the commodity container 1 has an open bottom, the air permeability of the unit can be improved, the efficiency for cooling the commodities S to be stored particularly in a refrigerator can be expected to be improved.

FIG. 7 through FIG. 12 show the third embodiment of the commodity display unit according to the present invention.

The commodity display unit of this embodiment is formed by placing abreast a plurality of the commodity containers of the aforementioned first embodiment so as to form a plurality of display lanes 10 for juxtaposing the processions of commodities. This unit may be compared to combined commodity containers into one body having common partition side panels between the adjacent commodity lanes 10.

The commodity container 1 of this embodiment has the bottom panel 14 with the inclination angle θ at which the rollers 2 are arranged. The bottom panel 14 is provided on its lower surface with a strengthening rib 142 and has vent holes and retaining holes 144 for the roller supports.

Figure 9:
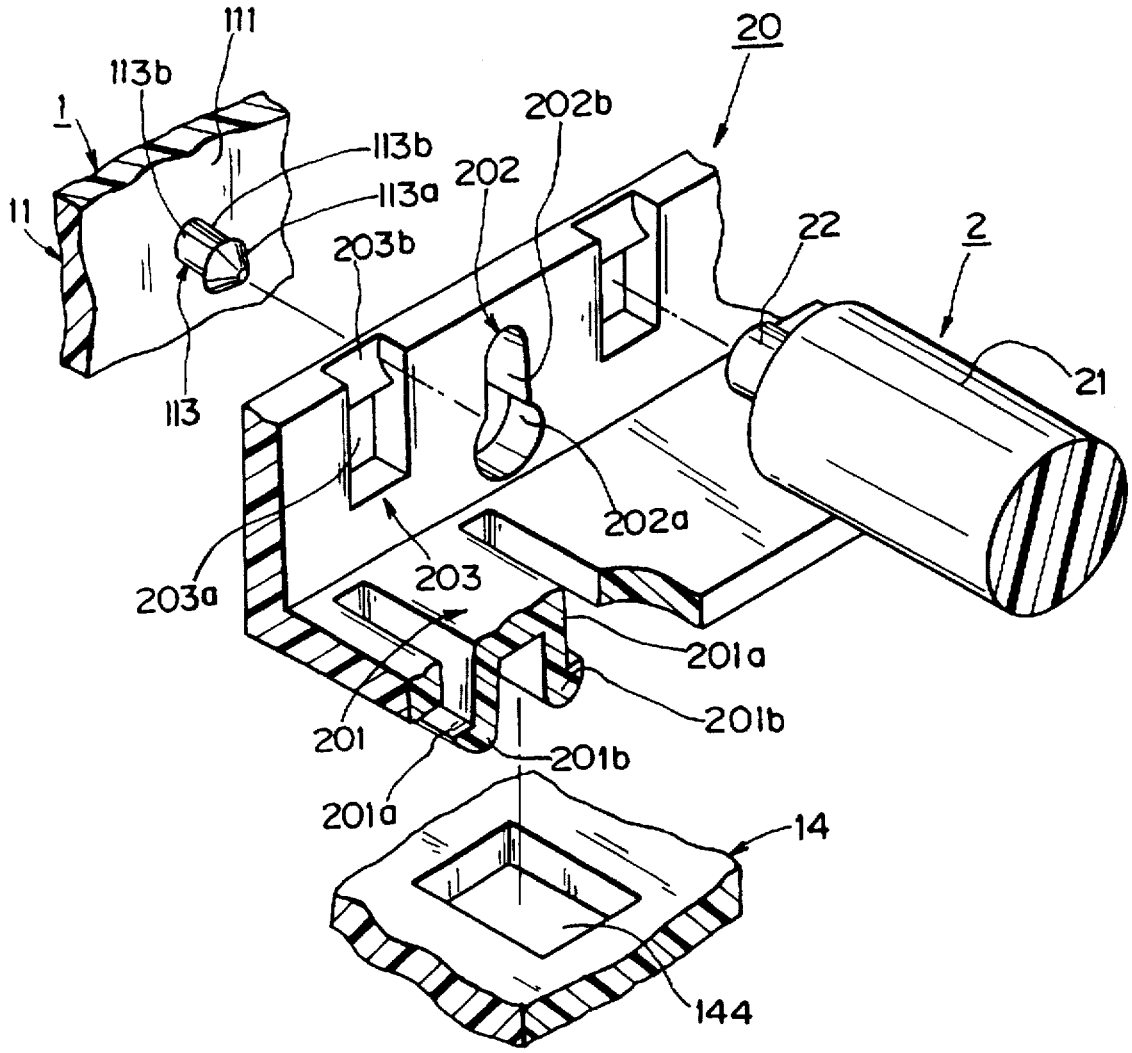
FIG. 9 is an enlarged perspective view showing a roller supporting structure of the unit of FIG. 7 in an exploded state.

On either side panel 11 of the commodity container 1, there are provided protruded hooks 113 for retaining the roller supports, each having a large-diameter conical head 113*a* and a small-diameter shank 113*b*, as illustrated in FIG. 9. By means of the protruded hooks 113, an L-sectioned roller support 20 is retained.

The roller support 20 has elastic projecting fixtures 201 formed opposite the retaining holes 144 in the bottom panel 14 of the commodity container 1, fitting holes 202 bored opposite the protruded hooks 113 for retaining the roller supports which are provided on the side panel 11 of the commodity container 1, and bearing grooves 203 for rotatably supporting the rollers 2.

The elastic projecting fixture 201 has leg portions 201*a* extending downward in the form of a fork, and catches 201*b* formed by bending the end portions of the leg portions 201*a* outward, so as to establish engagement by pressing the fixture 201 into the retaining holes 144 bored in the bottom panel 14 of the container 1.

The fitting hole 202 is formed of a large hole 202*a* for permitting the large-diameter conical head 113*a* of the protruded hook 113 to pass therethrough, and a small hole 202*b* for permitting the small-diameter shank 113*b* to pass therethrough. Thus, the protruded hook 113 is engaged inextricably with the fitting hole 202 by passing the large-diameter head 113*a* through the large hole 202*a*, and shifting the small-diameter shank 113*b* to the small hole 202*b*.

Figure 10:
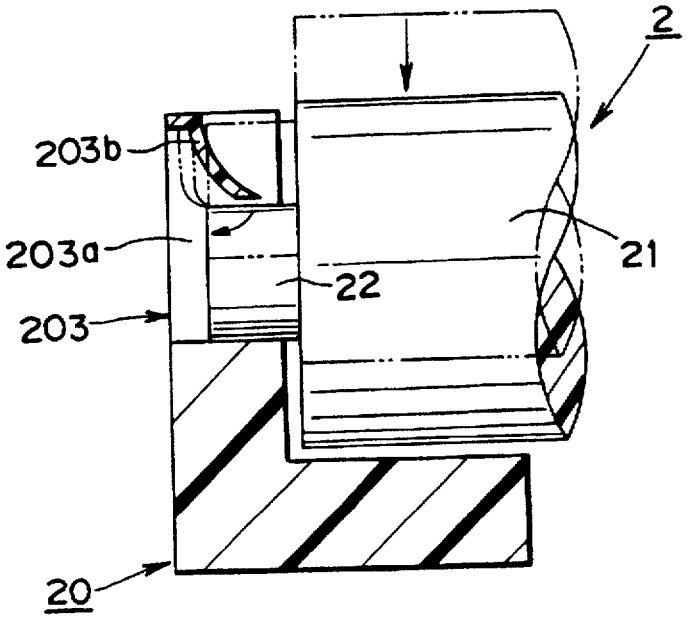
FIG. 10 is a transverse sectional view showing the assembled state of the roller supporting structure of FIG. 9.

The bearing groove 203 is formed of a rectangular supporting groove 203*a*, and a flexible piece 203*b* disposed in the supporting groove 203*a*, which can be elastically deformed. Thus, the shaft 22 of the roller 2 is nonreturnably settled in position in the supporting groove 203*a* by pushing downward the roller shaft into the supporting groove 203*a* while deforming elastically the flexible piece 203*b* as shown in FIG. 9 and FIG. 10.

Since the bearing groove 203 brings about edges in the upper surface of the roller support 20, it is desirable to make the upper surface of the roller support 20 slightly lower than the peak of the trunk 21 of the roller 2 (by the difference in height H' in FIG. 8), so as not to cause the commodity S sliding down the sloping rollers to be caught by the edges formed by the bearing grooves in the upper surface of the roller support.

On the front ends of the side panels 11 of the commodity container 1, there is disposed a substantially U-shaped clamp frame 114 for retaining substantially U-shaped engaging means 53 formed on the stopper 5, so that the stopper 5 can be detachably engaged with the commodity container 1.

The aforesaid clamp frame includes an engaging threshold or member 145 located at the front end of the bottom panel 14 of the commodity container 1, and correspondingly, the stopper 5 is provided on its lower part with an engaging claw 56, so that the stopper 5 can be steadily secured to the commodity container 1. The stopper 5 in this embodiment has a generally L-sectioned transparent or semitransparent membrane plate 54, and semicircular openings 55 formed in the membrane plate 54 for receiving the commodities S.

According to this embodiment, the components such as the rollers 2, roller supporters 20, and commodity container can be separably assembled with ease, because these components can be united in an interlocking manner. Since the stopper 5 is also separable, it can be chosen among stoppers of various shapes or exchanged in view of the shape of the commodity to be stored.

The commodity display unit with the display lanes 10 in this embodiment may be used in place of the shelf Aa of the display larder A.

Figure 11:
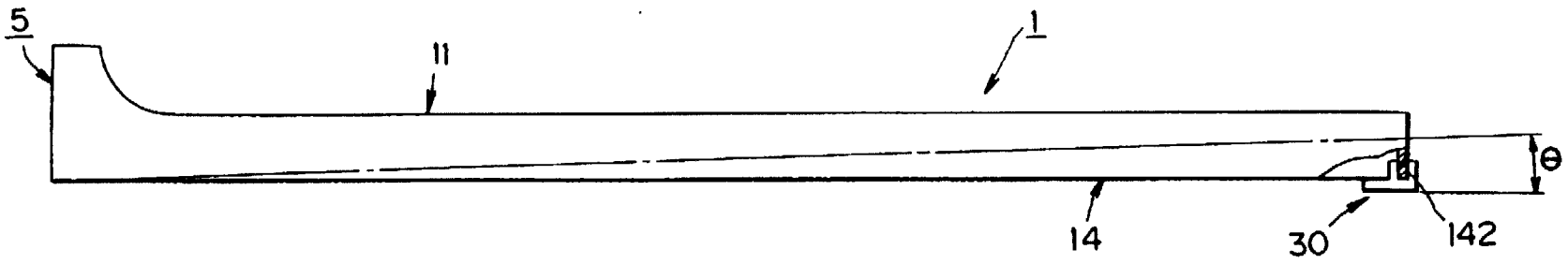
FIG. 11 is an enlarged side view of FIG. 7.
Figure 12:
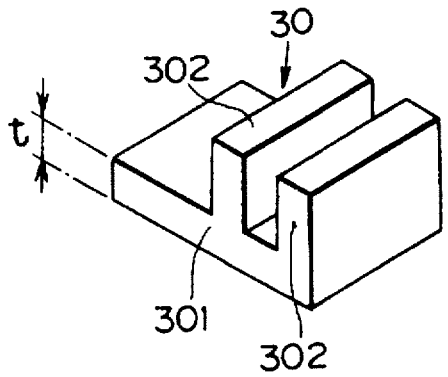
FIG. 12 is a perspective view showing the principal portion of the unit of FIG. 11.

When the unit is placed on the shelf Aa in use, it is desirable to place a spacer 30 below the rear portion of the unit so as to incline the procession of rollers 2 at the desired inclination angle θ, as shown in FIG. 11. The spacer 30 is formed of a base 301 having a fixed thickness t, and a fitting part 302 to be fitted to the strengthening rib 142 of the bottom panel 14 of the commodity container 1. By preparing a plurality of spacers 30 with the bases 301 having different thicknesses t, the inclination angle θ can be adjusted.

Figure 13:
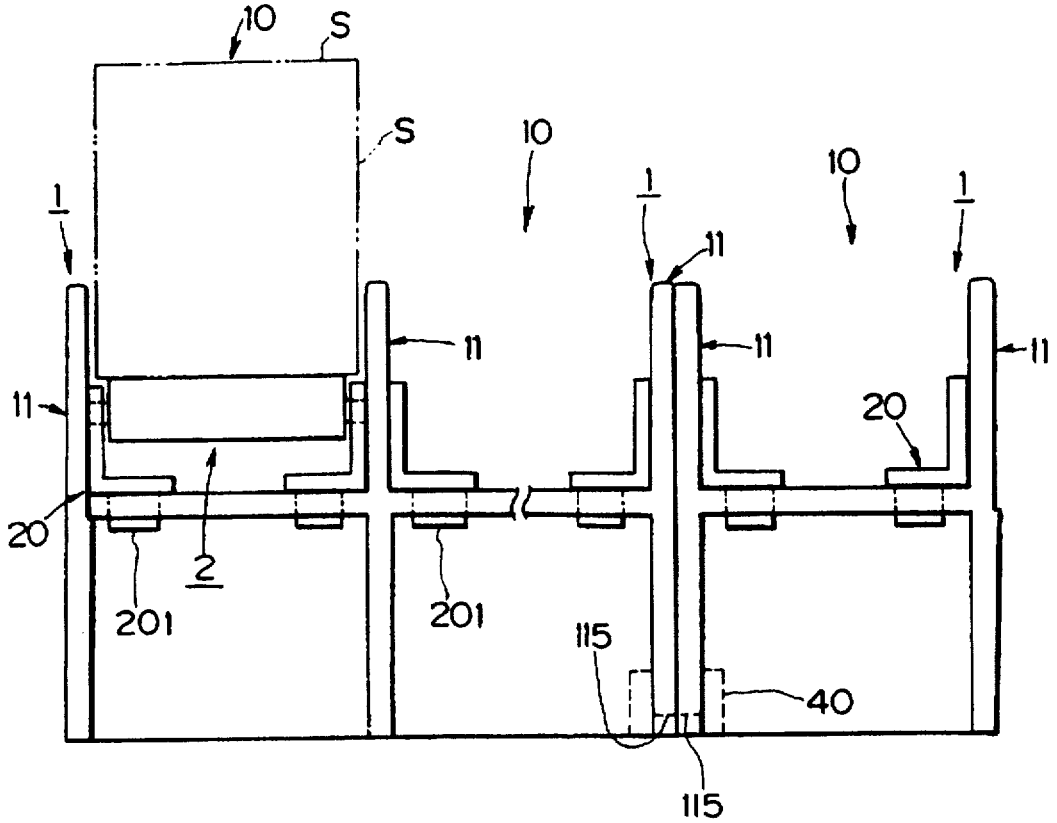
FIG. 13 is a rear view of a fourth embodiment of the commodity display unit of the invention.
Figure 14:
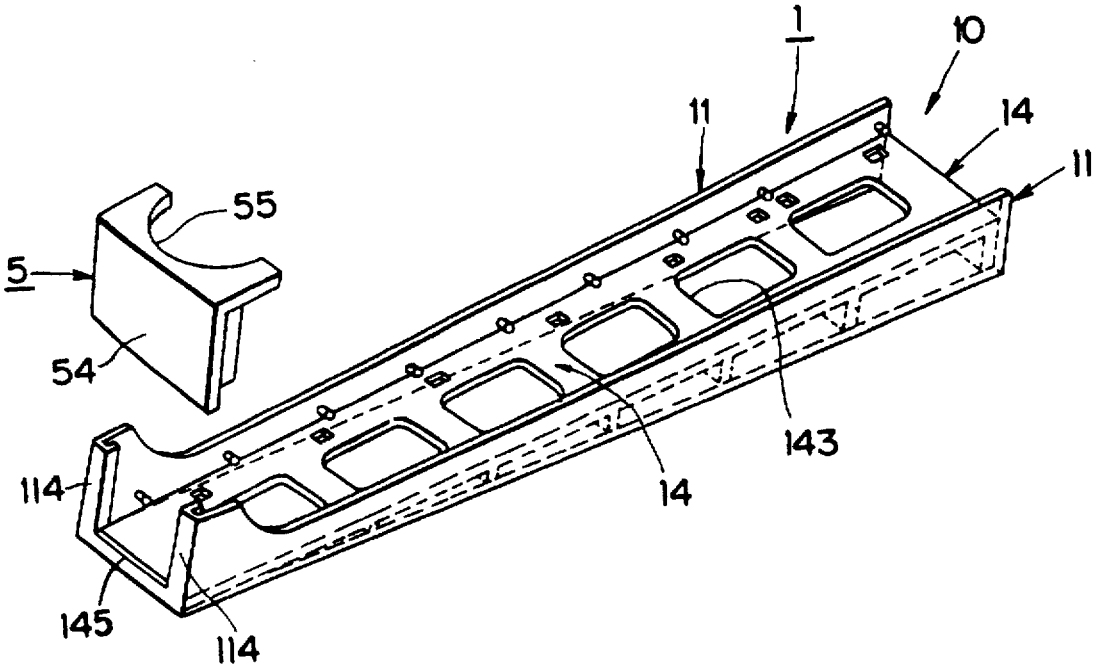
FIG. 14 is a perspective view showing the principal portion of the unit of FIG. 13.
Figure 15:
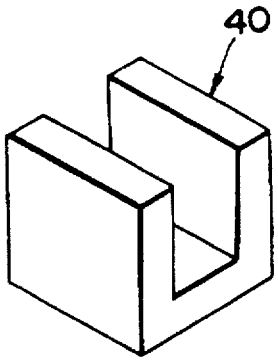
FIG. 15 is a perspective view showing another principal portion of the unit of FIG. 13.

FIG. 13 through FIG. 15 show the fourth embodiment of the commodity display unit according to the present invention, in which the display lanes 10 used in the aforenoted third embodiment are joined by using extension connectors 40.

The connector 40 is formed in the shape of a substantially U as shown in FIG. 15 so as to be fitted into a groove 115 formed in the side panel 11 of the commodity container 1. This connector 40 can be applied for the commodity container 1 having either the single display lane 10 or the plurality of display lanes 10.

According to this embodiment, the number of the display lanes 10 may be increased or decreased.

Figure 16:
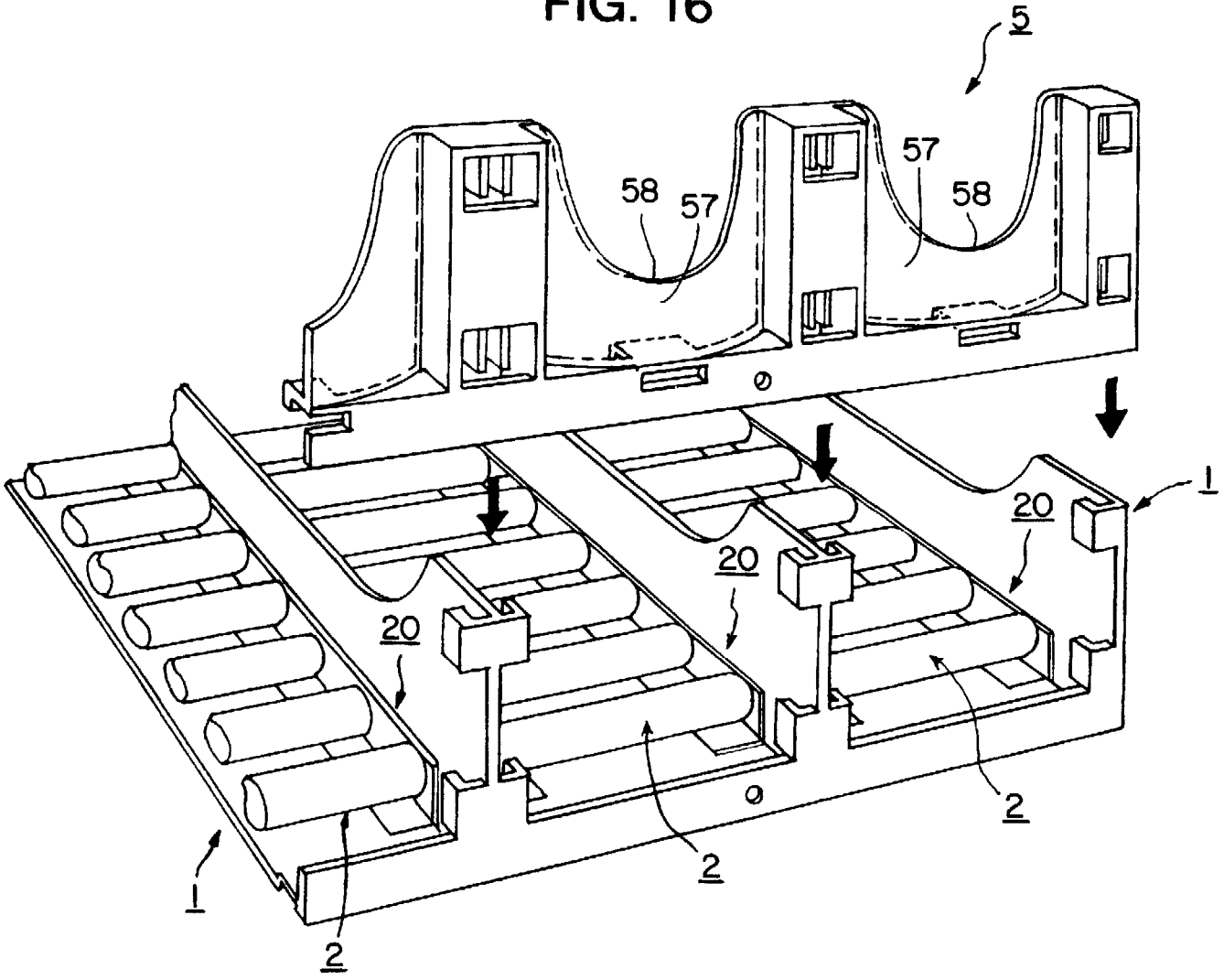
FIG. 16 is a perspective view showing the principal portion of a fifth embodiment of the commodity display unit according to this invention.

In FIG. 16 is shown the fifth embodiment of the commodity display unit according to the invention.

In the commodity container of this embodiment, the stopper 5 includes curved receiving portions 57 each having an opening 58 formed by elliptically cutting the upper portion of the receiving portion 57.

According to this embodiment, since the contact area between the receiving portion 57 and the commodity S is made large, the commodity S can be kept from falling down and pulled out through the opening 58 with ease.

Figure 17:
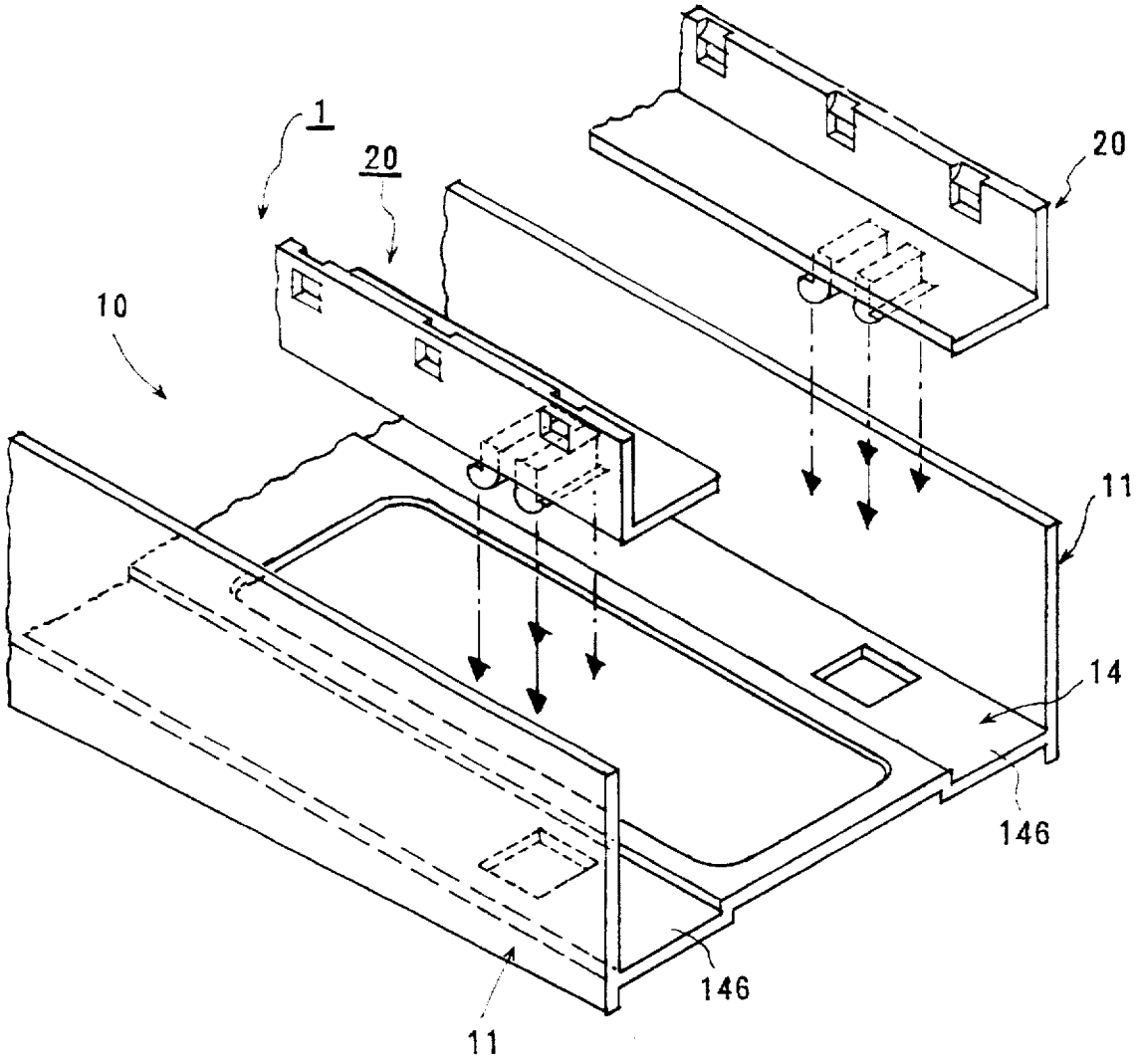
FIG. 17 is a perspective view showing the principal portion of a sixth embodiment of the commodity display unit according to this invention.

FIG. 17 shows the sixth embodiment of the commodity display unit according to the invention.

The commodity container 1 of this embodiment is provided in its bottom panel 14 with grooves 146 into which the roller support 20 is fitted.

According to this embodiment, the roller support 20 attached to the commodity container 1 can be prevented from wobbling.

The commodity display unit of this invention can be applied to not only the illustrated embodiments but also to a book shelf, table and any other conveniences. Moreover, the component parts constituting the unit of the invention can be selectively made of materials adequate to the environment in which this unit is used and the properties of the commodity to be stored.

As is apparent from the foregoing description, the commodity display unit according to the present invention can be removably placed on an existing commodity display shelf and contain a large number of commodities, thus enabling effective display and easy removal of the commodities. Besides, the commodities contained in a column in the unit of the invention can surely and smoothly move frontward spontaneously so as to be taken out from the front portion of the unit at the time and stably held without toppling sideways. Furthermore, the commodity display unit is convenient for taking in and out commodities and can be easily maintained because the commodity advancing means for causing the commodities to move spontaneously is easily assembled and disassembled. Although the invention has been described in its preferred forms with a certain degree of particularity, it is understood that the present disclosure of the preferred forms has been changed in the details of construction and the combination and arrangement of parts may be resorted to without departing from the spirit and the scope of the invention as hereinafter claimed.

[What is claimed is]:

1. A commodity display unit comprising:

a first side panel having a rear end and a front end;

a second side panel spaced from and parallel to said first side panel, said second side panel having a rear end and a front end, wherein said front ends of said first and second side panels define a commodity take out position;

a first lower roller support secured to an inner side surface of said first side panel, said first lower roller support having an upper surface provided with a plurality of semicircular bearing grooves;

a second lower roller support secured to an inner side surface of said second side panel, said second lower roller support having an upper surface provided with a plurality of semicircular bearing grooves;

a first upper roller support secured to an inner side surface of said first side panel, said first upper roller support having a lower surface provided with a plurality of semicircular bearing grooves;

a second upper roller support secured to an inner side surface of said second side panel, said second upper roller support having a lower surface provided with a plurality of semicircular bearing grooves;

a plurality of rollers supported on said first and second lower roller supports, wherein each of said rollers has a first end supported in one of said semicircular grooves of said first lower roller support, and a second end supported in one of said semicircular grooves of said second lower roller support; and a commodity stopper provided at said front ends of said first and second side panels.

2. The commodity display unit as claimed in claim 1, wherein:

said first lower roller support and said first upper roller support are inclined, relative to a lower surface of said first side panel, from said rear end of said first side panel downwardly towards said front end of said first side panel; and said second lower roller support and said second upper roller support are inclined, relative to a lower surface of said second side panel, from said rear end of said second side panel downwardly towards said front end of said second side panel.

3. The commodity display unit as claimed in claim 1, wherein said rollers define a support surface which is at or above the level of a plane defined by the uppermost surfaces of said first and second upper roller supports.

4. The commodity display unit as claimed in claim 1, wherein said first lower roller support and said first upper roller support are detachably secured to each other, and said second lower roller support said second upper roller support are detachably secured to each other.

5. The commodity display unit as claimed in claim 1, wherein said first lower roller support and said first upper roller support are detachably secured to said first side panel, and said second lower roller support and said second upper roller support are detachably secured to said second side panel.

6. The commodity display unit as claimed in claim 1, further comprising a third side panel spaced from and parallel to said second side panel, wherein said first and second side panels define a first display lane, and said second and third side panels define a second display lane.

7. The commodity display unit as claimed in claim 1, further comprising a rear panel interconnecting said rear ends of said first and second side panels, wherein said rear panel and said rear ends of said first and second side panels define a commodity supply opening, and an upper surface portion of a rearwardmost one of said rollers is at a level which is higher than an uppermost surface of said rear panel.

8. The commodity display unit as claimed in claim 7, wherein said rear panel includes indicia of the commodity to be supplied through said commodity supply opening.

9. The commodity display unit as claimed in claim 1, wherein said commodity stopper is detachably secured to said front ends of said first and second side panels.

10. A commodity display unit comprising:

a first side panel having a rear end and a front end;

a second side panel spaced from and parallel to said first side panel, said second side panel having a rear end and a front end, wherein said front ends of said first and second side panels define a commodity take out position;

an inclined bottom panel interconnecting said first and second side panels;

a first roller support secured to an upper surface of said bottom panel and an inner side surface of said first side panel, said first roller support having a plurality of bearing grooves;

a second roller support secured to the upper surface of said bottom panel and to an inner side surface of said second side panel, said second roller support having a plurality of bearing grooves, wherein each of said bearing grooves of said first and second roller supports has an elastic retaining structure;

a plurality of rollers supported on said first and second roller supports so as to span substantially the entire distance between said first and second side panels, wherein each of said rollers is supported on a roller shaft which has a first end supported in one of said bearing grooves of said first roller support and a second end supported in one of said bearing grooves of said second lower roller support; and a commodity stopper provided at said front ends of said first and second side panels.

11. The commodity display unit as claimed in claim 10, wherein each of said first and second roller supports are L-shaped.

12. The commodity display unit as claimed in claim 11, wherein each of said first and second roller supports includes a plurality of downwardly extending elastic projections, and said inclined bottom panel includes a plurality of retaining holes into which said elastic projections are received.

13. The commodity display unit as claimed in claim 10, wherein said rollers define a support surface which is at or above the level of a plane defined by the uppermost surfaces of said first and second roller supports.

* * * * *